US005611114A

United States Patent [19]

Wood, Jr. et al.

[11] Patent Number: 5,611,114

[45] Date of Patent: Mar. 18, 1997

[54] HIGH STRENGTH, DUAL ACTION HINGE

[76] Inventors: Vincent Wood, Jr.; Vincent Wood, Sr., both of 4920 Kebbe Dr., Sterling Heights, Mich. 48310

[21] Appl. No.: 461,533

[22] Filed: Jun. 5, 1995

[51] Int. Cl.[6] ..... E05D 3/06

[52] U.S. Cl. ..... 16/366; 16/371

[58] Field of Search ..... 16/366, 345, 371, 16/341, 342, 374

[56] References Cited

U.S. PATENT DOCUMENTS

| | | | |
|---|---|---|---|
| 1,100,338 | 6/1914 | Wright . | |
| 1,107,863 | 8/1914 | Sturdevant . | |
| 1,429,881 | 9/1922 | Howe . | |
| 2,288,013 | 6/1942 | Moynahan et al. | 29/11 |
| 2,345,562 | 4/1944 | Atwood | 29/11 |
| 2,689,370 | 9/1954 | Stone | 16/371 |
| 2,893,727 | 7/1959 | Barnard | 268/74 |
| 3,619,853 | 11/1971 | Merrill | 16/366 |
| 3,647,257 | 3/1972 | Litchfield | 296/91 |
| 4,433,866 | 2/1984 | Hagiwara | 296/76 |
| 4,684,167 | 8/1987 | Newmayer | 296/202 |
| 4,700,984 | 10/1987 | Kinaga et al. | 296/146 |
| 4,713,862 | 12/1987 | Kinaga et al. | 16/223 |
| 4,716,623 | 1/1988 | Kinaga et al. | 16/371 |
| 4,768,277 | 9/1988 | Vogt et al. | 29/434 |
| 4,864,687 | 9/1989 | Calcaterra et al. | 16/382 |
| 5,095,582 | 3/1992 | Ohlsson | 16/235 |
| 5,282,293 | 2/1994 | Pedoeem | 16/342 |

FOREIGN PATENT DOCUMENTS

| | | | |
|---|---|---|---|
| 2811739 | 9/1979 | Denmark | 16/371 |
| 3915502 | 11/1990 | Denmark | 16/366 |
| 0160048 | 4/1979 | Netherlands | 16/366 |
| 2033956 | 5/1980 | United Kingdom | 16/371 |

*Primary Examiner*—Chuck Y. Mah

*Attorney, Agent, or Firm*—Gifford, Krass, Groh, Sprinkle, Patmore, Anderson & Citkowski, P.C.

[57] ABSTRACT

A dual acting, high strength hinge includes an L-shaped, monolithic, formed metal support member. The support member includes a first and a second leg which are joined at a vertex. A first bore passes through the first leg near its free end, and a second bore passes through the support member near the vertex. A first hinge pin passes through the first bore and pivotally attaches a first hinge plate to the first leg. A second hinge pin passes through the second bore and pivotally attaches a second hinge pin to the support member near the vertex.

15 Claims, 3 Drawing Sheets

26
12
3
12a 18b
10
28
38
38
16
24
22b
30
34
38
20
L
14
18a
16a
W
38
22a
3
V
T
16b
14a
36
32

20

18b
10
12
16a
16
V
16b
24
22b
36
16c
14

HIGH STRENGTH, DUAL ACTION HINGE

FIELD OF THE INVENTION

This invention relates generally to hinges. More particularly, the invention relates to dual action hinges which include two hinge pins linking three elements. Most specifically, the invention relates to a high strength, dual action hinge incorporating a monolithic formed metal member.

BACKGROUND OF THE INVENTION

Hinges of various configuration have long been used to join members so as to permit them to move relative to one another. The particular configuration of hinge will depend upon the application. In a simple hinge, two members are supported so as to pivot, relative to one another, about an axis, typically defined by a pin associated with the hinge. Dual action, or other multiple action hinges include a number of pivot axes and provide for a more complex motion between two or more members. For example, dual action hinges are utilized on some vehicular doors and gates to provide a tightly sealed closure; and in such applications, the dual action hinges permit complex motion to take place between the door or gate and the vehicle thereby allowing latching and sealing to occur. Multiple action hinges utilized in vehicular applications are shown, for example, in U.S. Pat. Nos. 4,713,862; 3,647,257 and 2,893,727. One particular application for dual action hinges is in securing rear cargo doors on minivans, and such hinges have previously been fabricated from welded-together sheet steel stock.

Any hinge utilized to attach a door or gate to a motor vehicle should have sufficiently high strength so as to prevent opening, and possible loss of the door, in a collision. It is further desirable that any such hinge be fairly light in weight and that the cost and labor associated with its fabrication and installation be relatively low. Heretofore employed welded hinges have been found, in some instances, to be prone to failure; additionally, the welding process involves a number of steps and the use of specialized equipment. Therefore, there is a need for a low cost, high strength, dual action hinge of the type which may be utilized for affixing doors, and gates to motor vehicles.

The present invention provides a simple, high strength, dual action hinge which is ideally suited for vehicular applications. The hinge includes a monolithic, formed metal member together with relatively simple, thin, sheet metal plates. The hinge of the present invention is of a simple design and is easy to fabricate employing relatively low cost materials. The hinge provides a high degree of strength so as to give a long service life and a high degree of safety in a crash. These and other advantages of the present invention will be readily apparent from the drawings, discussion and description which follow.

BRIEF DESCRIPTION OF THE INVENTION

There is disclosed herein a dual action, high strength hinge which comprises a first and a second hinge plate, each of which includes a generally planar attachment portion and a cylindrical barrel portion defining a passageway therethrough. The hinge further includes a monolithic, formed metal support member which is configured as a generally L-shaped body having a first leg with a first cylindrical bore defined therethrough proximate a free end thereof, and a second leg joined to the first leg in an angular relationship therewith so as to define a vertex. The support member further includes a second cylindrical bore defined therethrough proximate the vertex. The hinge includes a first hinge pin which is disposed so as to pass through the barrel of the first hinge plate and through the first bore so as to hingedly attach the first hinge plate to the first leg. The hinge further includes a second hinge pin disposed so as to pass through the barrel of the second hinge plate and through the second bore so as to hingedly attach the second hinge plate to the support member.

The support member is typically configured so that each leg has a thickness which is less than its width or length. The thickness of the leg of the support member is thicker than the thickness of the hinge plates, and is most preferably at least three times thicker than the hinge plates. The thickness of the hinge plates is typically in the range of 3/32 inch to 1/8 inch and the thickness of the legs of the support member is at least 1/4 inch.

The hinge plates are preferably configured so as to be attachable to a structure such as a motor vehicle, and in a specific embodiment, one of the hinge plates is attachable to the body of a motor vehicle and the other hinge plate is attachable to a lift gate of a motor vehicle. The support member may include an integral stop portion thereupon for limiting travel of the hinge relative to one of the plates. The support member is a formed metal body and may be prepared by techniques such as powder metallurgy, casting, machining, extrusion and the like.

DETAILED DESCRIPTION OF THE INVENTION

The present invention is directed to a dual action, high strength hinge which includes monolithic, formed metal support member. In the context of the present disclosure, the term "monolithic" member refers to a unitary member fabricated from a single body of material. The term formed metal member refers to a member which is manufactured by a process such as forging, extruding, casting, machining or powder metallurgical techniques of the type wherein a powdered metal is compacted under high pressure and sintered to provide a unitary body of metal. As will be described in greater detail hereinbelow, the hinge includes a pair of plates, which are pivotably attached to the monolithic support member to provide a dual hinge action.

Figure 1:
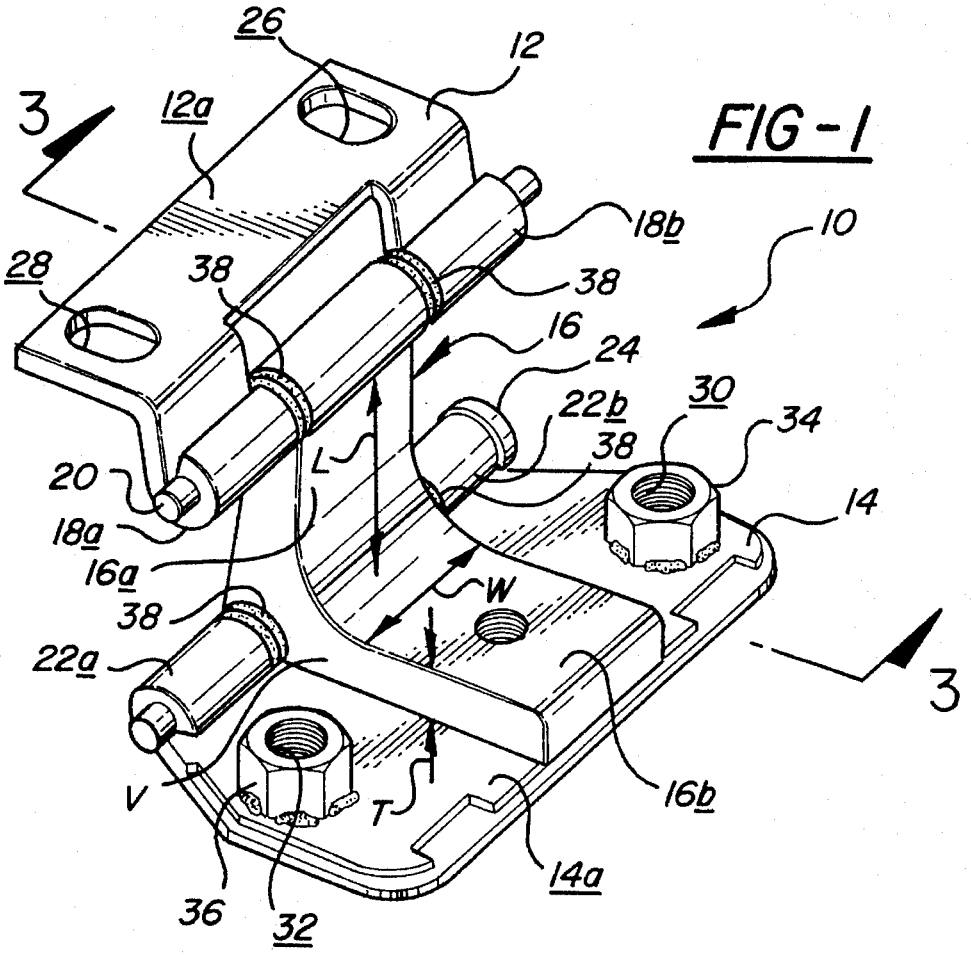
FIG. 1 is a perspective view of one embodiment of hinge structured in accord with the principles of the present invention.

Referring now to FIG. 1, there is shown one embodiment of hinge 10 structured in accord with the principles of the present invention and which is typical of hinges structured in accord herewith which are used to mount rear lift gates onto minivans. The hinge 10 includes a first hinge plate 12 and a second hinge plate 14 pivotably joined to a monolithic, formed metal support member 16. Each hinge plate 12, 14 includes an attachment portion **12*a*, 14*a*, which is generally planar and which is utilized to fasten the hinge to a vehicle or the like. The hinge plates 12, 14 further include a barrel portion which defines a cylindrical passage configured to receive a hinge pin. In the illustrated embodiment, each barrel portion is comprised of two segments, for example, first hinge plate 12 includes barrel portion having a first segment 18***a* and a second segment 18*b*, each of which are defined by tabs which project from the hinge plate 12 and which are bent in an arc so as to define a passageway which is configured to receive and retain a hinge pin 20. Similarly, the second hinge plate 14 includes a barrel portion comprised of segments 22*a*, 22*b* which receive and retain a hinge pin 24. It is to be understood that while the barrel portion is described as being a segmented barrel portion defined by bent tabs, the barrel portion may be otherwise configured. For example, the barrel portion may comprise an extruded channel, a welded on member or the like.

The hinge plates 12, 14 are preferably fabricated from relatively thin steel sheet stock, generally having a thickness in the range of 5/32 to 1/8 inch; although, thicker or thinner members may be utilized in certain applications. As illustrated, the hinge plates 12, 14 each include mounting holes for affixing the plates to an item such as a motor vehicle body or gate. The first plate 12 includes two openings 26, 28 therethrough, each configured to receive the threaded shank of a bolt, a rivet or other such fastener. The second plate 14 includes openings 30, 32 therethrough, and in this embodiment, the openings each have a nut 34, 36 attached thereto, as for example, by welding or brazing. The nuts 34, 36 function to permit attachment of the second plate 14 to a substrate by means of a threaded bolt or the like. Clearly, other means may be utilized to affix the attachment portions of the hinge plates 12, 14 to a substrate. For example, the plates may be affixed by welding, brazing or high strength industrial adhesives, and in such instances, the openings may be eliminated from the hinge plates.

Also shown in the FIG. 1 embodiment is the support member 16. This member is generally L-shaped and includes a first leg 16*a* and a second leg 16*b* which join at a vertex V. The first leg 16*a* has cylindrical bore defined therethrough near its free end (i.e. the end removed from the vertex V). The support member 16 further includes a second bore defined therethrough near to the vertex V. The legs of the support member 16 each have a width dimension W running generally parallel to the first and second bores and a length dimension L running from their free ends to the vertex V. The legs further have a thickness dimension T orthogonal to the width and length.

In the illustrated embodiment, the first hinge pin 20 passes through the bore of the first leg 16*a* of the support member 16 and through the two segments 18*a*, 18*b* of the barrel of the first plate 12*a* so as to pivotably attach the first plate 12*a* to the first leg 16*a*. The second hinge pin 24 similarly passes through the second bore of the support member 16 and through the two segments 22*a*, 22*b* of the barrel of the second hinge plate 14 so as to pivotably attach the second hinge plate 14 to the support member 16. In the illustrated embodiment, a set of shims 38 is disposed between each barrel segment 18*a*, 18*b*, 22*a*, 22*b* and the support member 16. These shims 38 are optional and are preferably fabricated from a low friction material such as organic polymer.

Figure 2:
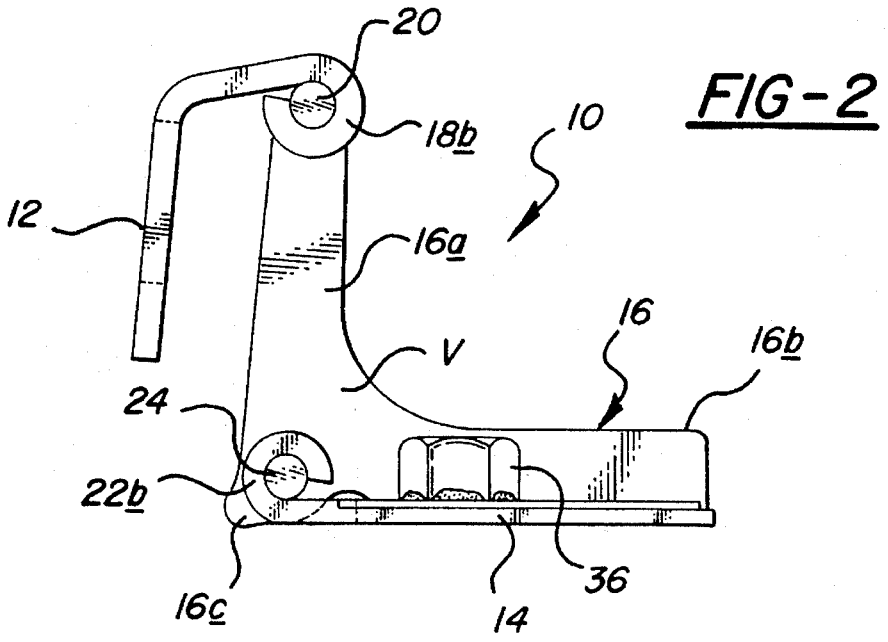
FIG. 2 is a side elevational view of the hinge of FIG. 1.

Referring now FIG. 2, there is shown a side view of the hinge 10 of FIG. 1. Visible in this Figure is the first hinge plate 12, a segment 18*b* of the barrel portion thereof and the hinge pin 20 all as retained at free end of the first leg 16*a* of the support member 16. Also visible in the Figure is the second hinge plate 14 together with a segment 22*b* of its barrel and the associated hinge pin 24 as disposed to retain the second hinge plate 14 proximate the vertex V of the support member 16. FIG. 2 also illustrates a stop member 16*c* integral with, and defined by a portion of the support member 16. The stop member 16*c* is comprised of a projection from the support member 16 at a point near the vertex thereof and it operates to limit the degree to which the support member 16 and second plate 14 pivot relative to one another about the axis defined by the second hinge pin 24.

Figure 3:
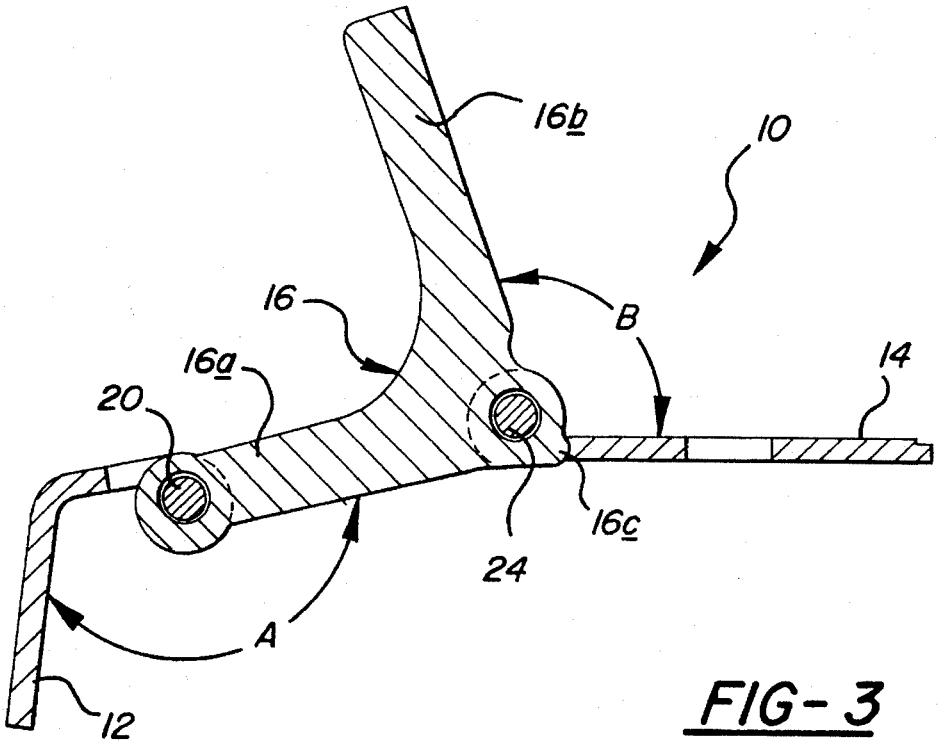
FIG. 3 is a cross sectional view of the hinge of FIG. 1 taken along line 3—3.

In this regard, refer to FIG. 3, which is a cross sectional view of the hinge of FIG. 1 taken along line 3—3. Illustrated in FIG. 3, the hinge 10 is a dual pivoting action in which the first hinge plate 12 and support member 16 pivot relative to one another about the axis defined by the first hinge pin 20, as indicated by arrow A. The second hinge plate 14 and support member 16 pivot relative to one another about an axis defined by the second hinge pin 24, as indicated by arrow B so that the bottom face of the second leg 16*b* moves in and out of contact with an upper face of the second hinge plate 14. The support member includes a stop portion 16*c* integral therewith, and as the second plate 14 and support member 16 pivot relative to one another, the stop member 16*c* will impinge upon an edge of the second hinge plate 14 thereby limiting the pivotal motion. By selection of the size of the stop member 16*c* and its placement, the degree of restriction may be controlled. It will be appreciated that a similar feature may be incorporated into the hinge with regard to the first plate 12.

Figure 4:
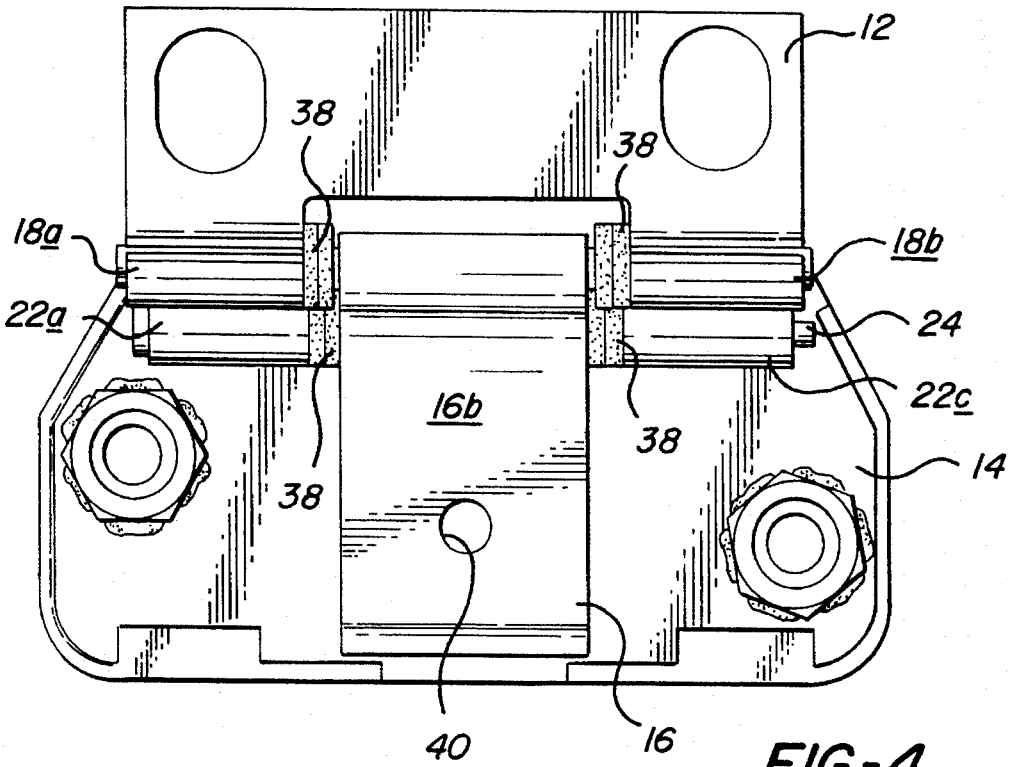
FIG. 4 is a top plan view of the hinge of FIG. 1.

Referring now to FIG. 4, there is shown a top plan view of the hinge 10 of FIG. 1. This view more clearly illustrates the bushings 28 and their placement relative to the support member 16 and barrel segments 18*a*, 18*b*, 22*a*, 22*b*. Still visible in the FIG. 4 illustration is a tapped hole 40 in the second leg 16*b* of the support member 16. The hole 40 is aligned with a corresponding hole in the second hinge plate 14, and is utilized in combination with a threaded bolt (not shown) to immobilize the second leg 16*b* against the second hinge plate 14 during shipping and handling of the hinge. This bolt is removed before, or just after the hinge is installed. This feature is optional.

Figure 5:
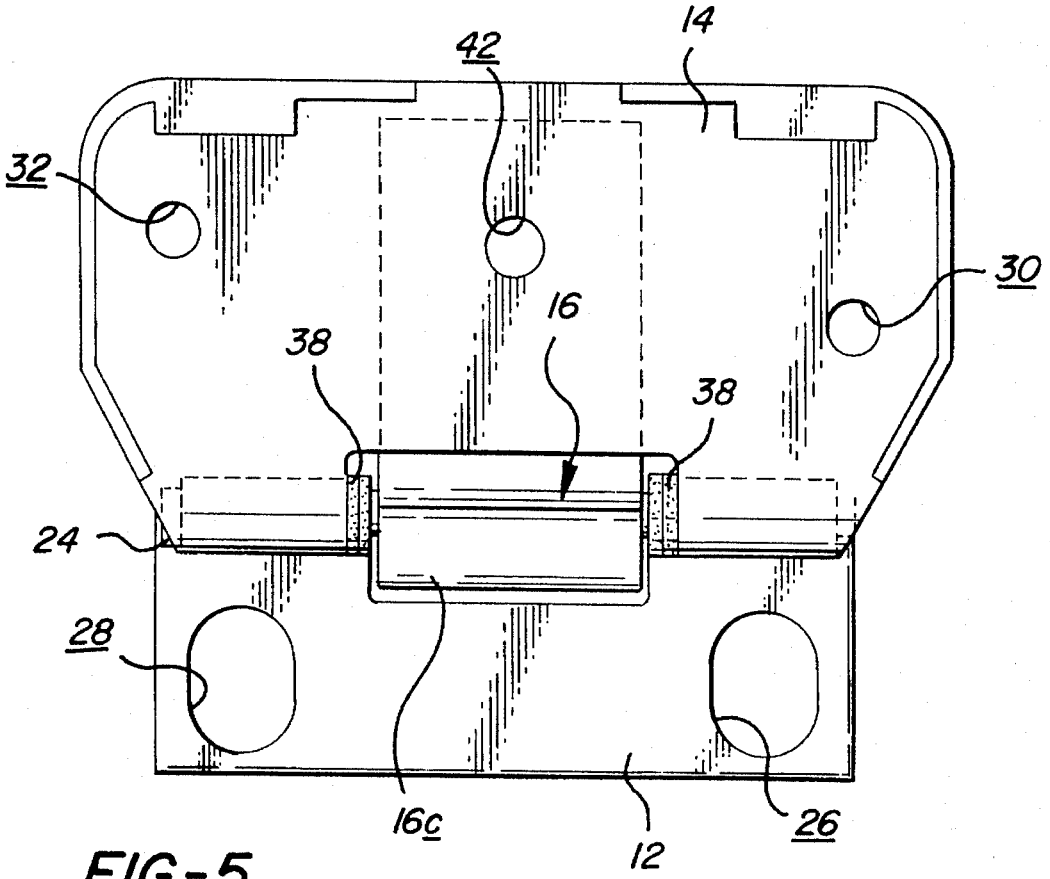
FIG. 5 is a bottom plan view of the hinge of FIG. 1.

Referring now to FIG. 5, there is shown a bottom plan view of the hinge of FIG. 1, better illustrating the lower surface of the second hinge plate 14 and the attachment holes 30, 32 therethrough. Also illustrated is a third hole 42 which as described with reference to FIG. 4; communicates with the opening 40 (shown in FIG. 4) in the second leg. The FIG. 5 embodiment further illustrates the first hinge plate 12 and attachment openings 26, 28 therein. Shown in FIG. 5 is the second hinge pin 24 and a portion of the support member 16 specifically including the stop member 16*c*. As further illustrated, the bushings 38 associated with the second hinge pin 24 are also visible.

The hinge of the present invention is preferably fabricated from a high strength material such as a metal, and is most typically fabricated from a ferrous alloy. The hinge plates are generally fabricated from sheet steel having a thickness of less than 1/4 inch, and preferably a thickness of less than 1/8 inch. In general, the thickness will range between 1/16 and 1/8 inch and more preferably between 5/32 and 1/8 inch. The plates are shown as being planar; although, some curvature or other shaping may be included to accommodate particular applications. In most instances, the plates will include some embossed or coined portion to facilitate alignment or retention, and such plates shall all be referred to herein as generally planar.

The monolithic formed metal support member will generally have a thickness at least three times that of the plates and is generally about ¼ inch thick. The width of the legs exceeds their thickness and is generally in the range of 0.5–2.0 inches. The length of the legs is comparable to the width. It is to be understood; however, that the foregoing dimensions are illustrative of particular embodiment of hinge. In instances where the hinge is used for affixing relatively large and/or heavy items, the dimensions, particularly the length and width dimensions of the legs may be increased within any practical constraints. It is also to be understood that in certain applications, a number of separate support elements, disposed with their first and second bores in linear alignment, may be employed to join together the first and second hinge plates. This embodiment is particularly advantageous when a relatively long hinge is to be fabricated. In other instances, the hinge may be made in a miniature or micro-miniature form for joining small and/or precision parts.

Figure 6:
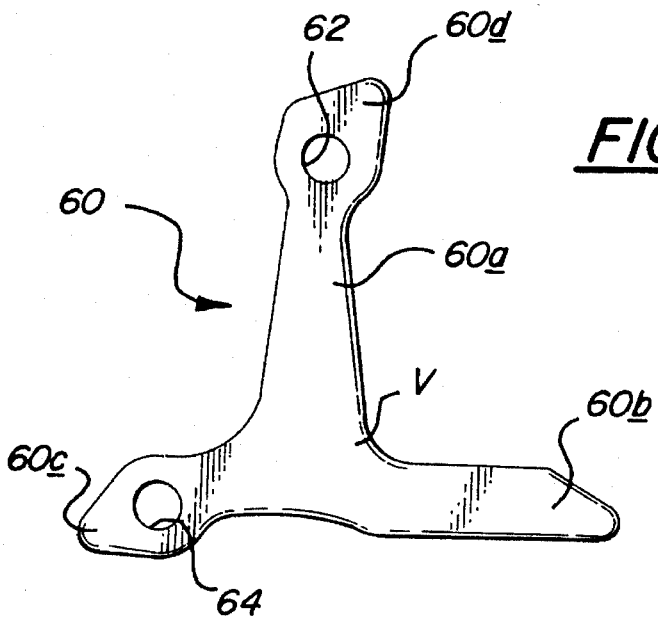
FIG. 6 is a side elevational view of another embodiment of support member structured in accord with the present invention.

It is to be understood that while one very specific support member has been described and discussed, this member may be otherwise configured in keeping with the spirit of the present invention. For example, FIG. 6 discloses another embodiment of support member 60 which may be utilized to fabricate a hinge in accord with the present invention, by affixing hinge plates thereto in a manner as previously described. The support member 60 of FIG. 6 is a monolithic member of generally L-shaped configuration including a first leg 60*a* and a second leg 60*b* joined at a vertex V. The first leg 60*a* includes a first bore 62 therethrough and a second bore 64 is disposed proximate the vertex on a projecting portion of the support member 60. The FIG. 6 embodiment includes a first stop portion 60*c* proximate the vertex V. The first stop member 60*c* operates as previously described to contact a hinge plate (not shown) and limit pivotal motion of the hinge plate and support member 60. The support member 60 further includes a second stop member 60*d* proximate the first bore 62. This second stop member 60*d* coacts with the other hinge plate to restrict the range of pivotal motion. Still other variations in the geometry of the support member may be implemented in accord with the present invention.

In view of the foregoing, it is to be understood and appreciated that numerous modifications and variations of the present invention may be practiced in accord with the teaching herein. The foregoing drawings, discussion and description are merely meant to illustrate particular embodiments of the invention, and are not meant to be limitations upon the practice thereof. It is the following claims, including all equivalents, which define the scope of the invention.

We claim:

1. A dual action, high strength, hinge comprising:

a first hinge plate and a second hinge plate, each hinge plate comprising a generally planar attachment portion and a cylindrical barrel portion defining a passageway therethrough;

a monolithic, formed metal, support member configured as a generally L-shaped body having a first leg with a first cylindrical bore defined therethrough proximate a free end thereof, and a second leg joined to said first leg in an angular relationship therewith so as to define a vertex, said support member further including a second cylindrical bore defined therethrough proximate said vertex and an integral stop portion defined thereon proximate said vertex;

a first hinge pin disposed so as to pass through the passageway defined by the barrel of said first hinge plate and through said first bore so as to hingedly attach the first hinge plate to the first leg; and a second hinge pin disposed so as to pass through the passageway defined by the barrel of the second hinge plate and through said second bore so as to hingedly attach the second hinge plate to the support member;

wherein, said stop portion is configured to engage the second hinge plate as said second hinge plate is pivoted upon said second hinge pin.

2. A hinge as in claim 1, wherein the first and the second leg of the support member each have a length extending from the vertex to a free end thereof, a width extending parallel to the first and second bores, and a thickness extending orthogonal to said length and said width, wherein said thickness is less than said width or said length.

3. A hinge as in claim 2, wherein said thickness of said support member is at least three times less than the width or length thereof.

4. A hinge as in claim 2, wherein said first and second hinge plates have a thickness which is substantially identical, and wherein the thickness of the support member is at least three times the thickness of the hinge plates.

5. A hinge as in claim 4, wherein said hinge plates have a thickness in the range of 3/32 inch to ⅛ inch.

6. A hinge as in claim 2, wherein thickness of said support member is at least ¼ inch.

7. A hinge as in claim 2, wherein said second hinge plate is hingedly attached to the support member by the second hinge pin so that a bottom face of said second leg, as defined by the width and length thereof, is moved in and out of contact with a face of the second plate, as said second plate is pivoted relative to the support member.

8. A hinge as in claim 1, wherein the attachment portion of each hinge plate includes a hole defined therethrough and configured to permit passage of a threaded portion of an attachment bolt to pass therethrough.

9. A hinge as in claim 8, wherein at least one hinge plate includes a nut affixed thereto and in registry with said hole, said nut having a threaded bore configured to retainably receive the threaded portion of the attachment bolt.

10. A hinge as in claim 1, wherein one of said first and second hinge plates is configured to be attachable to a body of a motor vehicle and the other of said plates is configured to be attachable to a lift gate of said motor vehicle.

11. A hinge as in claim 1, wherein said support member comprises a body of compacted, sintered, metal powder.

12. A hinge as in claim 1, wherein said support member comprises a ferrous metal body selected from the group consisting of: extruded metal bodies, cast metal bodies, and machined metal bodies.

13. A hinge as in claim 1, wherein the barrel portion of each of said first and second hinge plates is defined by at least one tab which projects from a respective one of said plates and which is bent into an arcuate shape so as to define said passageway.

14. A hinge as in claim 13, wherein each of said first and second hinge plates includes two of said tabs disposed in a spaced apart relationship thereupon, and wherein said barrel portion defined by said tabs comprises two linearly aligned segments.

15. A dual action, high strength, hinge comprising:

a first hinge plate and a second hinge plate, each hinge plate comprising a generally planar attachment portion and a cylindrical barrel portion defining a passageway therethrough;

a monolithic, formed metal, support member configured as a generally L-shaped body having a first leg with a first cylindrical bore defined therethrough proximate a free end thereof, and a second leg joined to said first leg in an angular relationship therewith so as to define a vertex, said support member further including a second cylindrical bore defined therethrough proximate said vertex;

a first hinge pin disposed so as to pass through the passageway defined by the barrel of said first hinge plate and through said first bore so as to hingedly attach the first hinge plate to the first leg; and a second hinge pin disposed so as to pass through the passageway defined by the barrel of the second hinge plate and through said second bore so as to hingedly attach the second hinge plate to the support member.

* * * * *